US006206213B1

(12) United States Patent
Conrad

(10) Patent No.: US 6,206,213 B1
(45) Date of Patent: Mar. 27, 2001

(54) CRANE WITH A LUFFING JIB

(75) Inventor: Frank Conrad, Hornbach (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/559,517

(22) Filed: Apr. 27, 2000

(30) Foreign Application Priority Data

Apr. 29, 1999 (DE) ..... 199 20 634

(51) Int. Cl.[7] ..... B66C 23/04
(52) U.S. Cl. ..... 212/292; 212/349
(58) Field of Search ..... 212/292, 348, 212/349, 350, 264, 230, 231

(56) References Cited

U.S. PATENT DOCUMENTS 3,845,866 * 11/1974 Euken ..... 212/292
4,036,372 * 7/1977 Rao et al. ..... 212/292
5,628,416 * 5/1997 Frommelt et al. ..... 212/349

FOREIGN PATENT DOCUMENTS 196 41 191 A1 3/1998 (DE) .
198 24 672 A1 12/1998 (DE) .
0 661 234 A1 7/1995 (EP) .

* cited by examiner

*Primary Examiner*—Thomas J. Brahan
(74) *Attorney, Agent, or Firm*—Henry M. Feiereisen

(57) ABSTRACT

A crane, includes a luffing jib having individual telescoping jib members, and a locking device configured for linkage of jib members and movable between an engagement position in which the jib members are locked together and a release position in which a first one of the jib members can be moved in and out relative to a second one of the jib members. The locking device is supported in the first jib member and received in a receptacle of the second jib member. A shifter, movable in an axial direction, is provided to shift the locking device via a coupling device between the engagement and release positions, with the coupling device extending perpendicular to the axis and connected to the shifter. The coupling device has a coupling member movable in a radial direction to effect an interlocking engagement with the locking device, which is movable in a same axis as the coupling member, wherein the locking device forms together with the coupling member a coupling between the shifter and the first jib member, and wherein in a transition phase between release and engagement positions, a projecting portion of the coupling member enters in interlocking engagement with the locking device.

26 Claims, 10 Drawing Sheets

II 3
5
1
2
5.1
9
11
21
16
6
13
24
29
8
32
17
12
5.1
7
4

CRANE WITH A LUFFING JIB

CROSS-REFERENCES TO RELATED APPLICATIONS

This application claims the priority of German Patent Application Serial No. 199 20 634.1, filed Apr. 29, 1999, the subject matter of which is incorporated herein by reference.

BACKGROUND OF THE INVENTION

The present invention relates, in general, to a crane with a luffing jib.

German Pat. No. DE 198 24 672 A1 describes a crane having a luffing jib which includes a main boom and a plurality of individual jib members configured to telescope in and out after a disengagement of locking bolted connections results in a release of the jib members to permit their in-and-out movement through coupling with a single-stage hydraulic piston and cylinder unit. In the extended or retracted position, the jib members can be locked, whereby the cylinder housing of the piston and cylinder unit is secured at its rearward end to an inner end of the main boom. The piston rod is connected at the forward end to a guide and traction device which is positioned in parallel relation to the piston and cylinder unit and has an inner end secured to a coupling and locking unit which can be coupled and locked with receptacles of the luffing jib members. The coupling and locking unit has two coupling bolts which are actuated mechanically via a slider formed with grooves. The coupling bolts are positioned in a horizontal plane and, to the right and left, can be pushed in and withdrawn from receptacles arranged at the inner end of the respective jib member. Actuation of the slider is implemented by an axial piston and cylinder unit which is connected to the coupling and locking unit, whereby the spring-loaded locking bolt can be retracted only when the coupling and locking unit is coupled with the receptacles of the jib member being extended or retracted, and release of the coupling bolt with the respective jib member can only be effected when the respective spring-loaded locking bolt is engaged.

European Pat. No. EP 0 661 234 A1 describes a crane with a luffing jib whose individual telescopic jib members can be extended and retracted after disengagement of locking bolts connections using only a single-stage piston and cylinder unit. The jib members are bolted in the respective extended or retracted positions by locking bolts which are spring-loaded toward their locked positions. The piston rod of the single-stage piston and cylinder unit is articulated to a joint member forming the inner end of the outer jib member. An entraining device can be coupled with receptacles of the telescopic jib members and is arranged in a part of the end of the cylinder, from which the piston rod projects out. The entraining device includes a hydraulic block with confronting cylinders for the extendible and retractable bolts formed by the pistons of the cylinders and locking the respective jib member, and a hydraulic piston and cylinder unit which is arranged perpendicular to the hydraulic block for actuation of the respective locking bolt. The hydraulic elements of the engagement device so interact that the radial piston and cylinder unit can be actuated for retraction of the respective locking bolt only when the engagement device is coupled with the jib member to be extended or retracted via the locking bolt.

German Pat. No. DE 196 41 191 A1 describes a luffing jib, in particular for stationary and mobile cranes, including telescopic jib members which move in and out by means of two continuous cables, which have each an entrance side and an exit side, in conjunction with a cable drive and cable deflecting rollers. In the retracted and extended positions, the jib members are secured against relative movement in axial direction by operatively connecting each jib member to a locking device. The cable drive and two cable deflecting rollers are arranged at the base of the main boom, and a third cable deflecting roller is arranged at a cable-drive-distal end of a guide tube which is supported within each jib member via a collar and rigidly secured to the main boom. The points of attachment of the cable end are received in a holding device which is equipped with a gripper unit and slides along the guide tube.

SUMMARY OF THE INVENTION

It is thus an object of the present invention to improve a crane with a luffing jib in such a manner that the coupling and locking unit is simplified to thereby save space and weight.

This object, and others which will become apparent hereinafter, are attained in accordance with the present invention by providing a luffing jib having individual telescoping jib members; a locking device configured for linkage of jib members and movable between an engagement position in which the jib members are locked together and a release position in which a first one of the jib members can be moved in and out relative to the a second one of the jib member, with the locking device being supported in the first jib member and received in an opening of the second jib member; an actuating device defining an axis and including a shifter, movable in a direction of the axis, for shifting the locking device via a coupling device between the engagement and release positions, wherein the coupling device extends perpendicular to the axis and is connected to the shifter, with the coupling device having a coupling member movable in a radial direction to effect an interlocking engagement with the locking device, which is movable in a same axis as the coupling member, wherein the locking device forms together with the coupling member a coupling between the shifter and the first jib member, and wherein in a transition phase between release and engagement positions, a projecting portion of the coupling member enters in interlocking engagement with the locking device, thereby realizing a safety mechanism that prevents the telescoping jib member to drop into the surrounding jib member.

To date, the functions, coupling and locking, were assumed by two components that had to be actuated separately, whereas in the transition phase both functions had to be operatively interconnected to ensure a secure bolting of the respective jib member in every operational phase, either via the coupling bolt or via the locking bolt or locking bolts. In accordance with the present invention, these two functions are now combined so that less components are required, thereby saving weight while still being reliable in operation in connection with implementing a secure bolting of the jib members during locking or coupling phases. In addition, as a result of the reduced number of components, the demand for space is reduced and thus, the present invention is applicable even for smallest telescoping jib members.

The actuating device for moving the jib members may be a cable drive, a single-stage or multistage piston and cylinder unit, or several piston and cylinder unit operated in parallel, for moving the jib members. When using a piston and cylinder unit, the piston rod or the cylinder housing may be securely fixed with the joint member of the main boom.

According to another feature, the form-fitting connection of the coupling member and the locking bolt is realized via a mushroom-shaped coupling piece positioned at the inner end of the locking bolt and engaging a recess formed in the coupling member. In conjunction with very small and light-weight luffing jibs, it is sufficient to provide only one locking device which can be disposed in the telescoping jib member centrally at the top or centrally at the bottom. The associated receptacle of the jib member enclosing the telescoping jib member is then suitably provided in the upper wall or bottom wall, respectively. In conjunction with bigger jibs, the provision of two locking devices may be suitable as a consequence of torque applied on the actuating device, wherein the axes of both locking devices and their interacting coupling devices intersect the center axis of the actuating device at a right angle. Suitably, both locking devices are arranged in opposing sidewall regions. However, an arrangement with both locking devices arranged in the top wall and bottom wall may be suitable as well.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
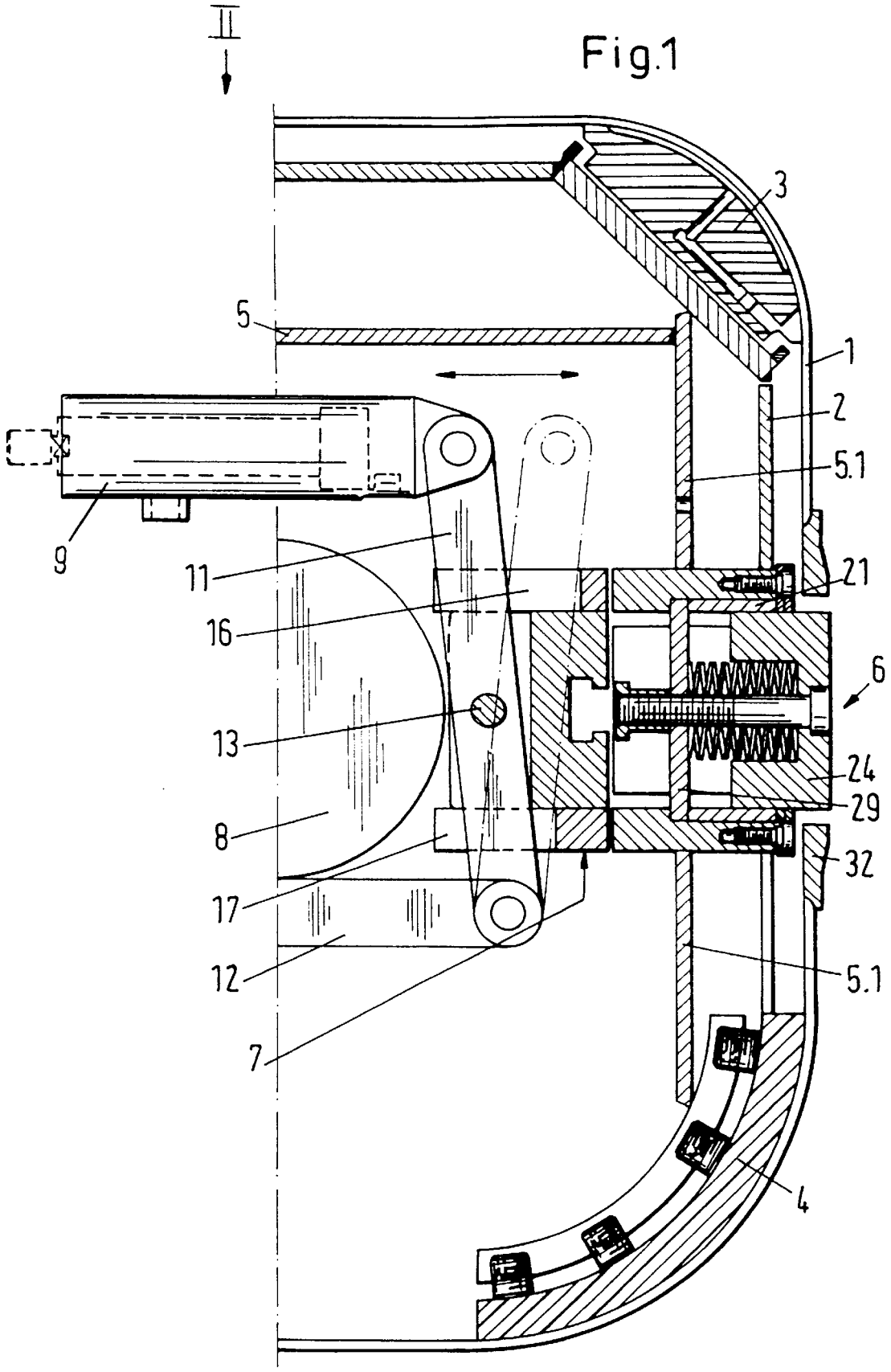
FIG. 1 is a cross sectional view of a right side of a luffing jib according to the present invention.

Throughout all the Figures, same or corresponding elements are generally indicated by same reference numerals.

Turning now to the drawing, and in particular to FIG. 1, there is shown a cross sectional view of a right side of a luffing jib according to the present invention in the region of its rear support. The luffing jib includes a plurality of jib members, only two jib members 1, 2 are shown in FIG. 1 for sake of simplicity. Persons skilled in the art will appreciate, however, that the principles described in the following description are equally applicable to luffing jib with more than two jib members.

The jib members 1,2 are guided by slide elements 3, 4 which are positioned in the rounded corners and made, preferably, of polyamide. The luffing jib has a framework 5 with a sidewall 5.1 which has an opening for support of a locking device, generally designated by reference numeral 6 and further received in the associated jib member 2. The locking device 6 includes a locking bolt 24 for cooperation with an axially moveable coupling member 15 of a coupling device, generally designated by reference numeral 7 and secured to a shifter 8 which is part of an actuating device (not shown), e.g. a cable drive or a hydraulic piston and cylinder unit. An exemplified construction and manner in which a cable drive as actuating device is typically operated is fully described in German Pat. No. 196 41 191 A1, the entire specification and drawings of which is expressly incorporated herein by reference. An exemplified construction and manner in which a hydraulic piston and cylinder unit as actuating device is typically operated is fully described in U.S. Pat. No. 5,628,416, the entire specification and drawings of which is expressly incorporated herein by reference. The hydraulic piston and cylinder unit has a cylinder and a piston rod which projects out from one end zone of the cylinder, with the piston rod being stationary and the coupling device 7 being arranged in the one end zone of the cylinder. It is however also possible to so configure the piston and cylinder unit that the cylinder is stationary, whereby the piston rod has mounted to its forward end a crossbar for attachment of a guide element at a distance to and parallel to the cylinder housing for connection to the coupling device 7 to the rearward end zone of the crossbar. A exemplified configuration of this reversed attachment of the piston and cylinder unit is fully described in German Pat. No. 198 24 672 A1, the entire specification and drawings of which is expressly incorporated herein by reference.

Figure 2:
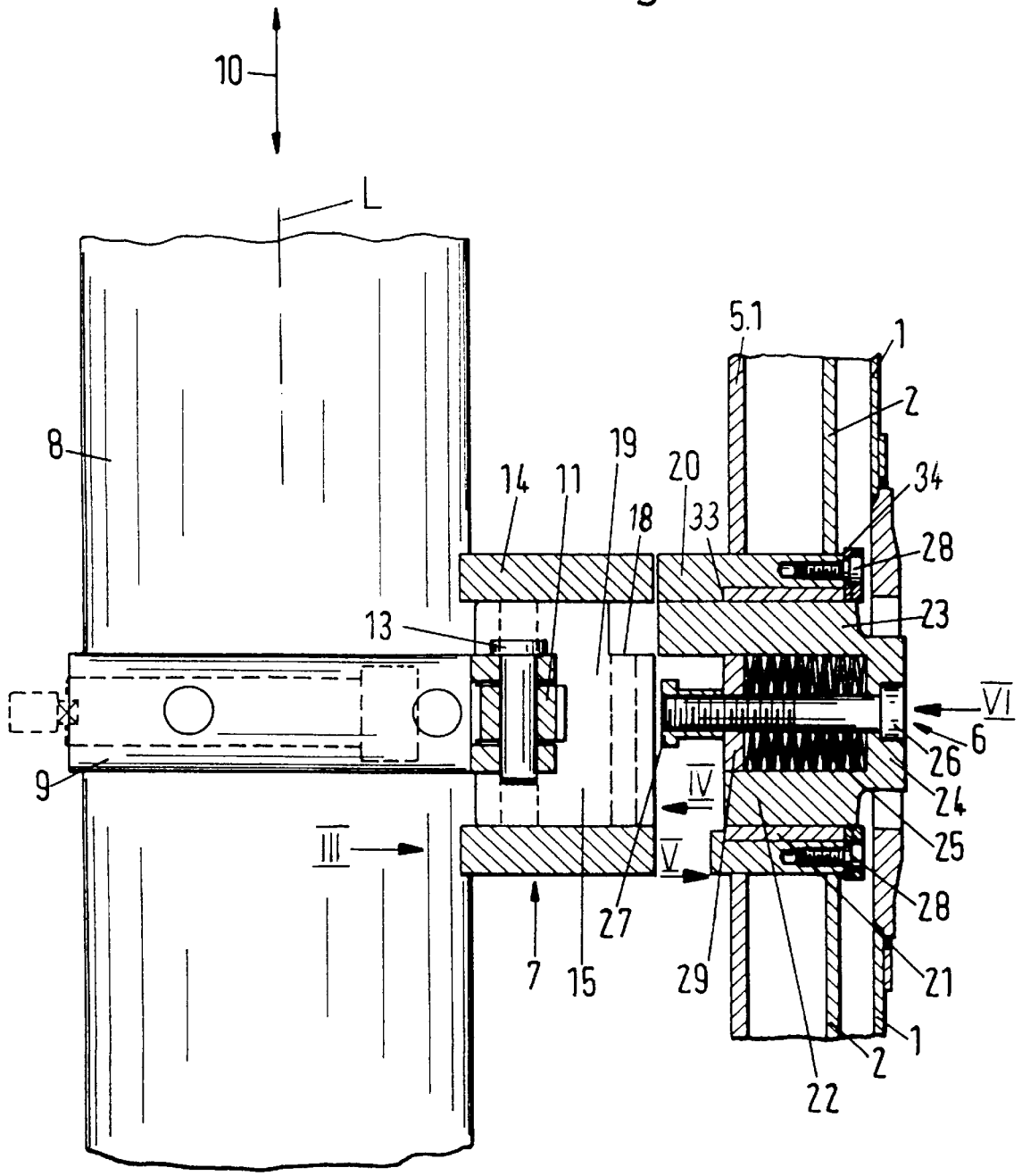
FIG. 2 is a partially sectional view of the luffing jib, taken along a view in the direction of arrow II in FIG. 1.

The shifter 8 defines a longitudinal axis L (FIG. 2) and is movable in the direction of the longitudinal axis L, as indicated by double arrow 10 in FIG. 2. In the following description, the term "upward" will denote a direction toward those portions of the luffing jib which appear on top of FIG. 2, while the term "downward" will denote the opposite location or direction. Thus, the upwardly pointing arrow of double arrow 10 indicates an extension of the jib member 2 ("moving out"), and the downwardly pointing arrow indicates a retraction of the jib member 2 ("moving in").

The coupling member 15 is operatively connected to a hydraulic piston and cylinder unit 9 which extends transversely to the longitudinal axis L of the shifter 8. A mechanical connection of the hydraulic piston and cylinder unit 9 with the coupling member 15 is implemented by a lever 11, having an upper end articulated to the piston and cylinder unit 9 and a lower end pivotally mounted to a fixed bars linkage 12, and a pin 13 which connects the lever 11 to the coupling member 15.

FIGS. 1 and 2 show a locked position between the jib member 2 and the surrounding jib member 1 and the option to position the coupling device 7 in the direction of double arrow 10 by means of the shifter 8 of the actuating device.

Figure 3:
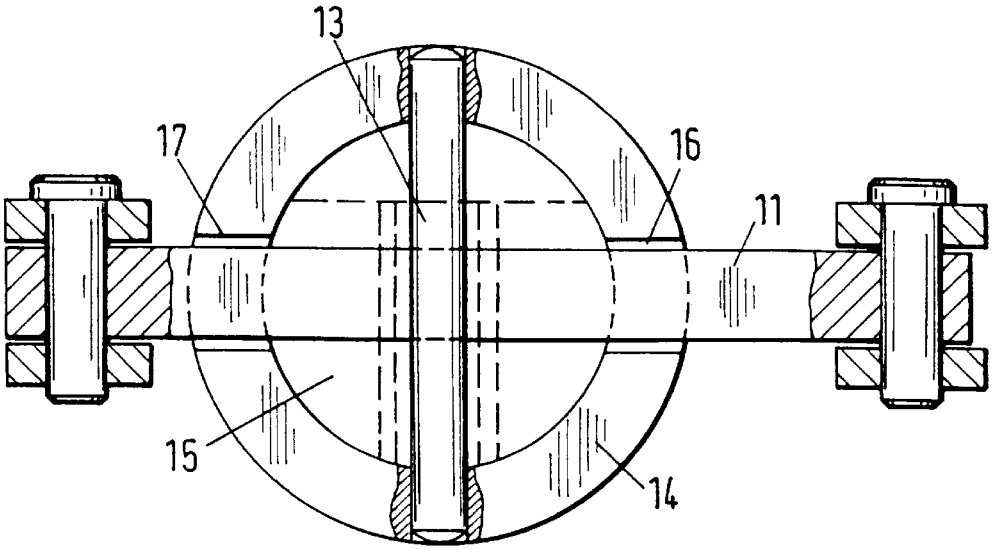
FIG. 3 is a partially sectional view of the luffing jib, taken along a view in the direction of arrow III in FIG. 2.
Figure 4:
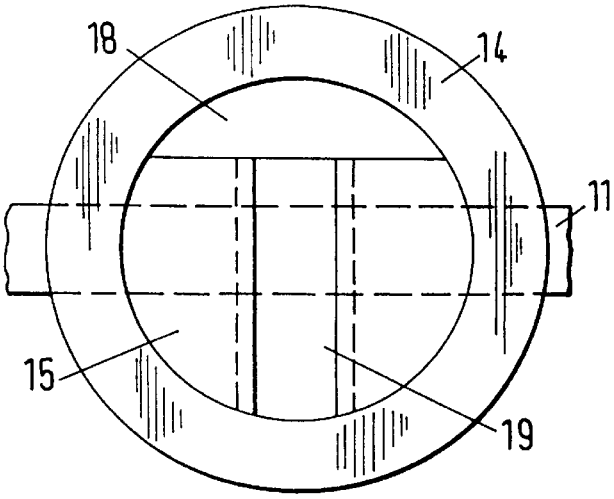
FIG. 4 is a partially sectional view of the luffing jib, taken along a view in the direction of arrow IV in FIG. 2.

As shown in FIG. 3, the coupling device 7 includes a cylindrical sleeve 14 which is securely fixed to the shifter 8 and circumscribe s the coupling member 15 which is movable in the direction of the locking device 6 via the pin 13 and the lever 11, with the sleeve 14 being formed, e.g. through milling, with axial bores 16, 17 for passage of the lever 11 and movement of the lever 11, as also depicted in FIG. 1 by dash-dot line. As shown in FIG. 4, the coupling member 15 is provided with a sickle-shaped recess 18 and a transverse bore 19 to allow an interlocking engagement between the coupling member 15 and the locking bolt 24, as will be described furtherbelow.

Figure 5:
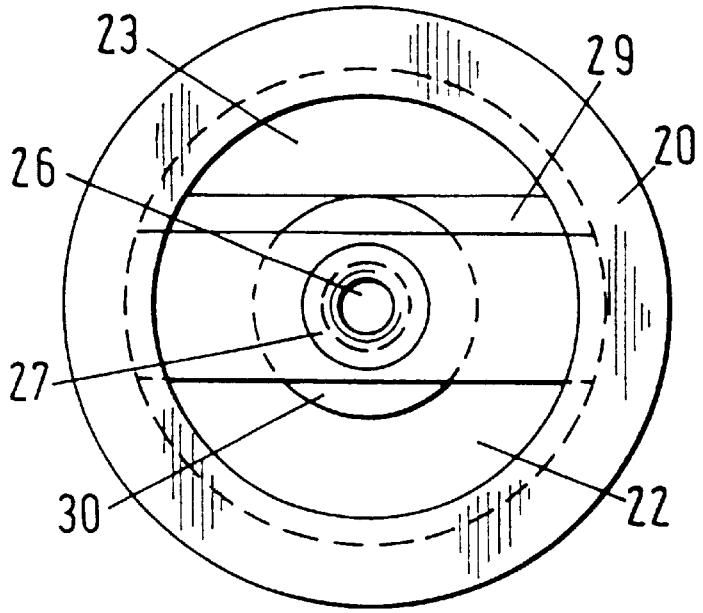
FIG. 5 is a partially sectional view of the luffing jib, taken along a view in the direction of arrow V in FIG. 2.
Figure 6:
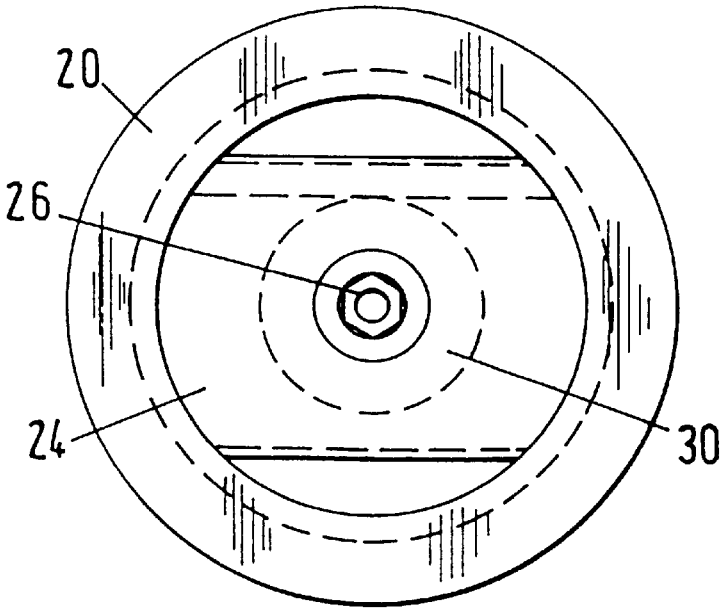
FIG. 6 is a partially sectional view of the luffing jib, taken along a view in the direction of arrow VI in FIG. 2.

Turning now in addition to FIGS. 5 and 6, there are shown further details of the locking device 6. The locking device 6 includes a sleeve 20 which is secured in the sidewall 5.1 of the framework 5 and in the jib member 2. The sleeve 20 has same inner and outer diameters as the sleeve 14 of the coupling device 7. Fitted in the sleeve 20 is a slide bush 21 for facilitating an axial sliding of the locking bolt 24. Arranged in the bottom area of the slide bush 21 is a crossbar 29 which is secured to the sleeve 20, for example, by welding. The crossbar 29 forms with the sleeve 20 two opposing sickle-shaped openings for receiving complementary, sickle-shaped legs 22, 23 of the locking bolt 24 (FIG. 5). A spring 25 is disposed in a central bore 30 of the locking bolt 24 and has one end supported by an bottom surface of the locking bolt 24 and another end bearing against the crossbar 29. Traversing the locking bolt 24 and the crossbar 29 in axial center position is a screw 26 which threadably engages a mushroom-shaped coupling piece 27. The slide bush 21 is secured against displacement in axial direction by a shoulder 33 of the sleeve 20*a* and a ring-shaped plate 34 which is fixed to the sleeve 20 by a plurality of circumferential fastening screws 28 (FIG. 2).

Figure 7A:
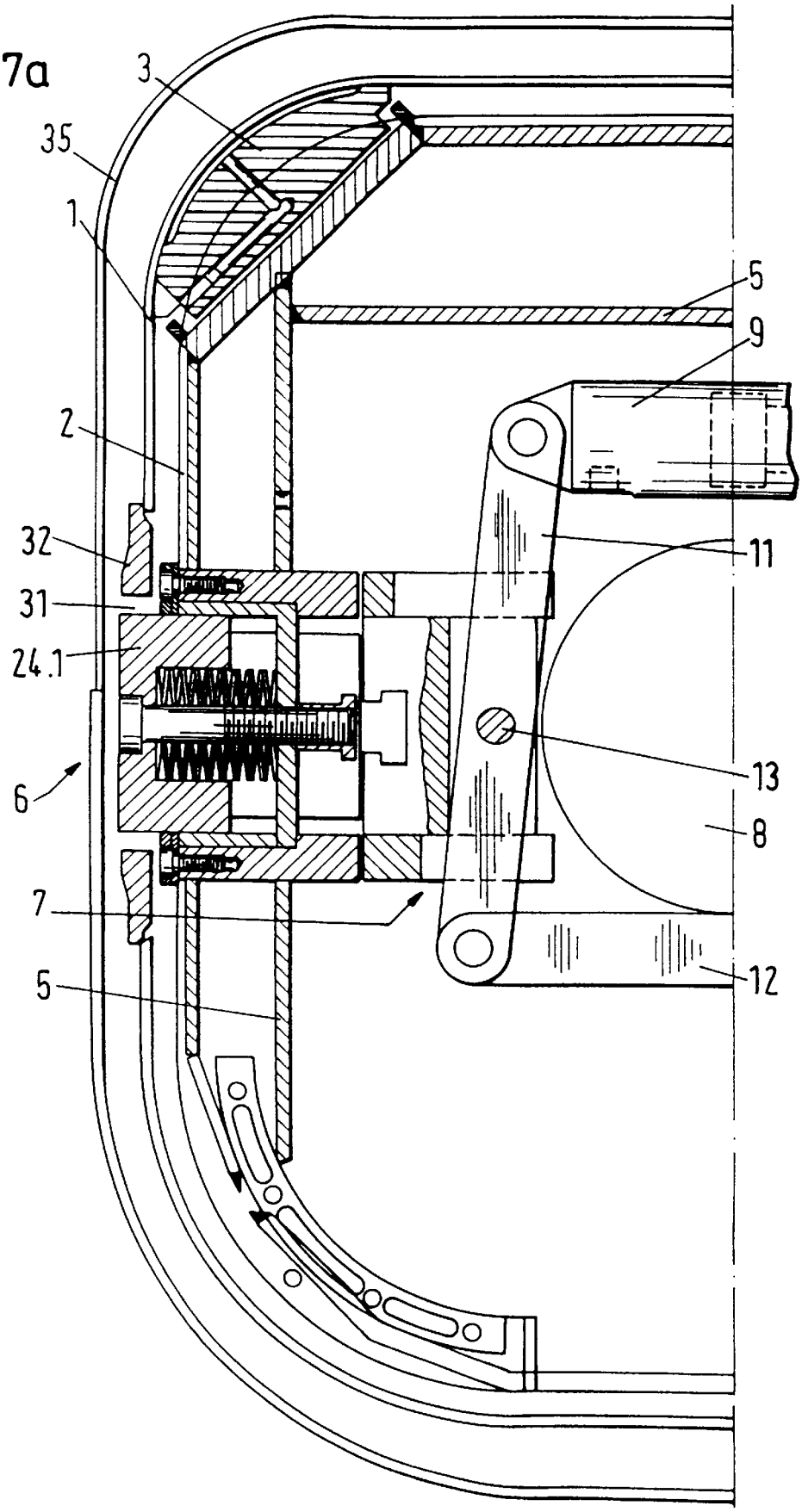
FIG. 7*a* is a cross sectional view of a left side of the luffing jib, illustrating a first phase of the coupling and release process.
Figure 7B:
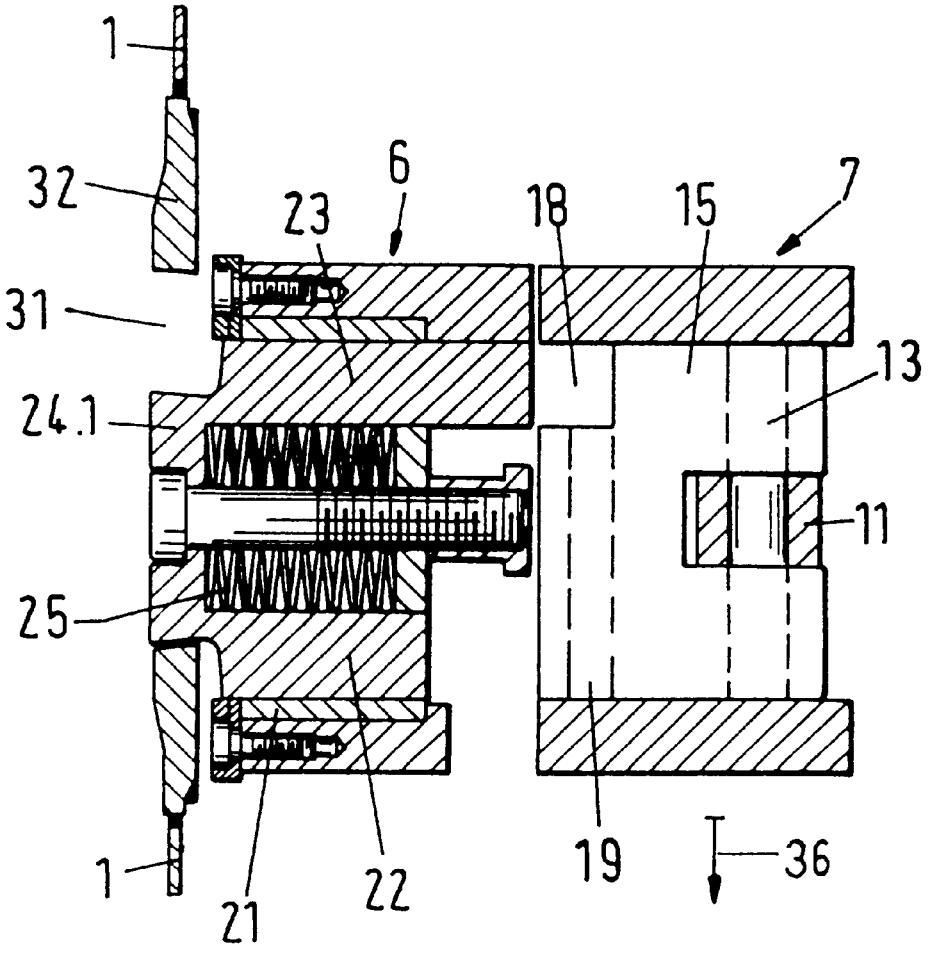
FIG. 7*b* is a cutaway view in longitudinal section of the luffing jib of FIG. 7*a*, illustrating in detail a coupling and locking device according to the present invention.

The phases of disengagement between the jib members 1, 2 via the coupling device 6 and locking device 7 will now be described with reference to FIGS. 7*a* to 9*c*. In order to elucidate that the luffing jib can have more than two jib members, FIGS. 7*a*. 8*a*. 9*a* show a further jib member 35 which surrounds the jib members 1, 2. As opposed to FIG. 1, FIG. 7*a* now shows the left hand side of the luffing jib in a comparable phase in which the jib member 2 is in locked disposition with the surrounding jib member 1. As the coupling and locking device on the left hand side is a mirror image of the coupling and locking device on the right hand side, parts corresponding with those in FIG. 1 are denoted by identical reference numerals and not explained again. It is also to be understood that the principles described in the following description with respect to the coupling and locking device on the left hand side are generally applicable to the coupling and locking device on the right hand side, whereby the movement of the opposing coupling devices 7 is implemented in unison by the shifter 8. It is assumed that a further inwardly positioned jib member has been extended, and the shifter 8 of the actuating device is on its return way to the jib member 2 being acted upon next. The return path is indicated in FIG. 7*b* by arrow 36.

During the return path, the coupling device 7 travels conjointly with the shifter 8 of the actuating device past the locking device 6 of the jib member 2. Although not shown in detail, sensors are provided for registering a correct disposition of the coupling device 7 with respect to the locking device 6. The locking bolt 24 is held in locked position by the spring tension of the spring 25. Thus, the head portion 24.1 of the locking bolt 24 is urged into engagement in a receptacle 31 formed in the surrounding jib member 1. Suitably, the receptacle 31 is reinforced by a ring-shaped insert 32 for absorbing weight forces. Arrow 36 points in the direction of retraction ("moving in") so that the own weight of the jib member 2 forces the head portion 24.1 of the locking bolt 24 against the rear edge zone of the ring-shaped insert 32, as shown in FIG. 7*b*.

Figure 8A:
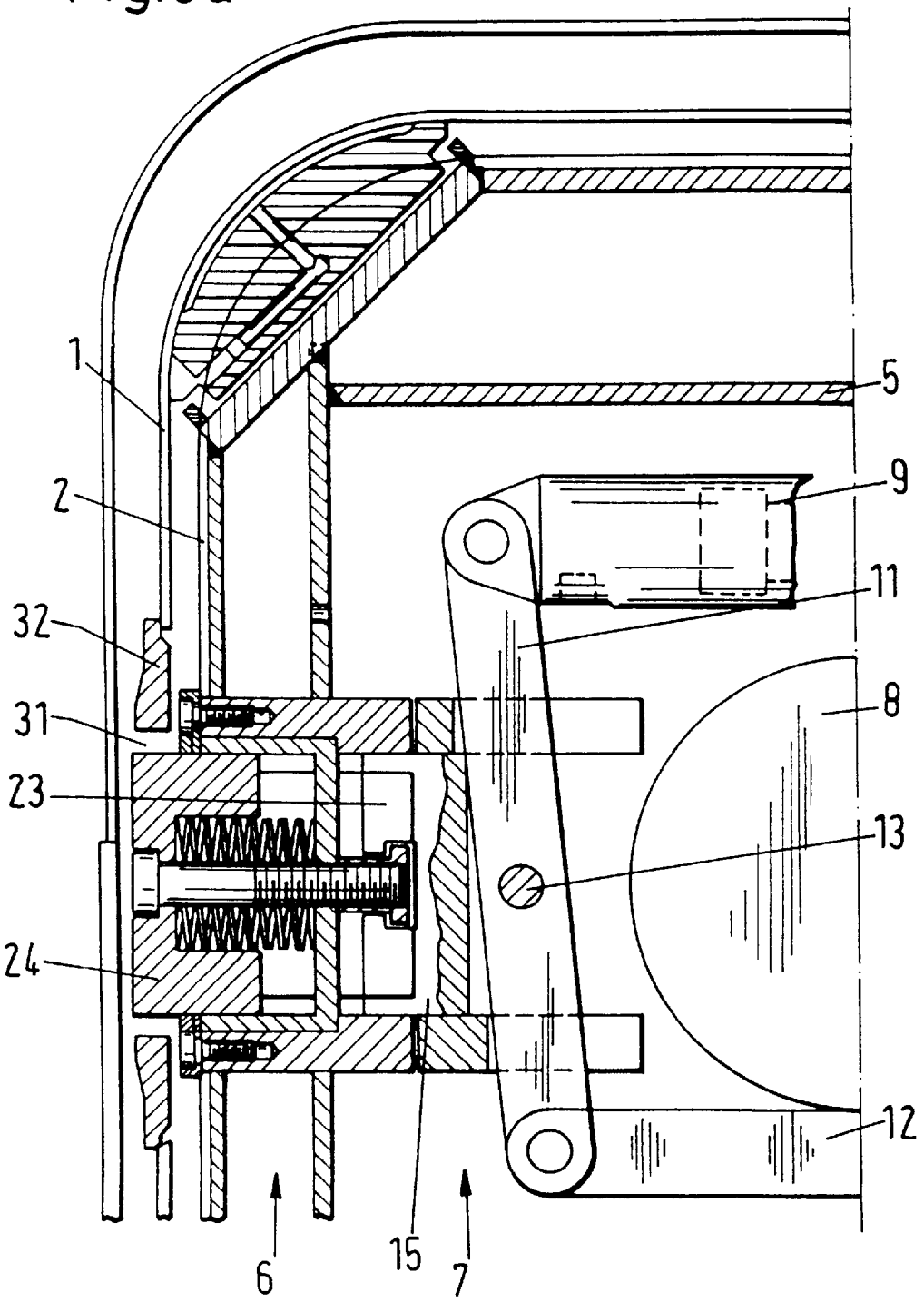
FIG. 8*a* is a cross sectional view of the luffing jib of FIG. 7*a* in a second phase of the coupling and release process.
Figure 8B:
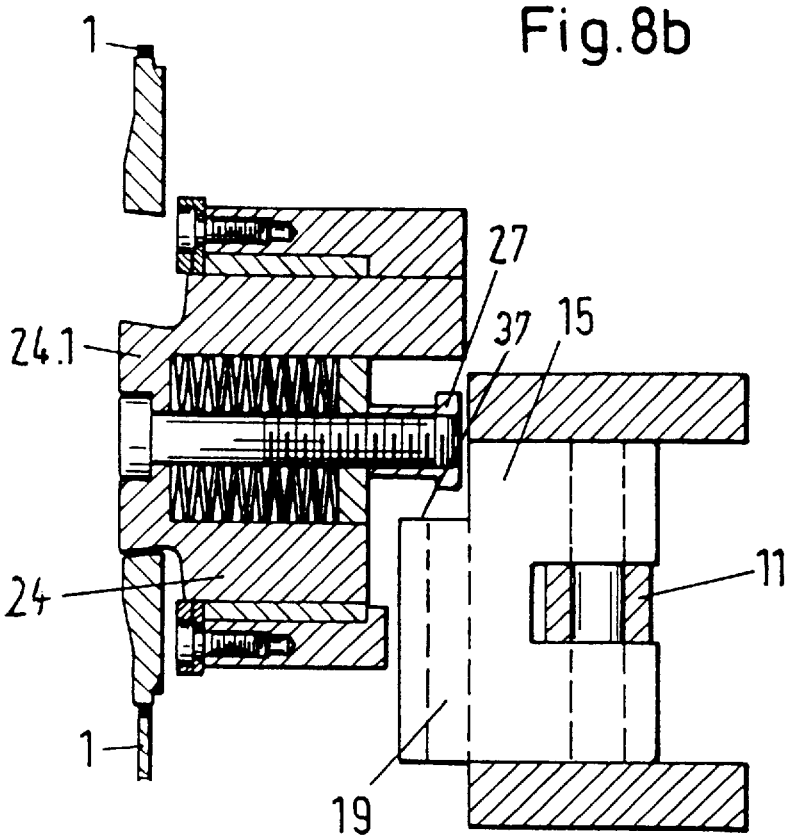
FIGS. 8*b,c* are cutaway views in longitudinal section of the luffing jib of FIG. 8*a*, illustrating in detail movement patterns during the second phase.
Figure 8C:
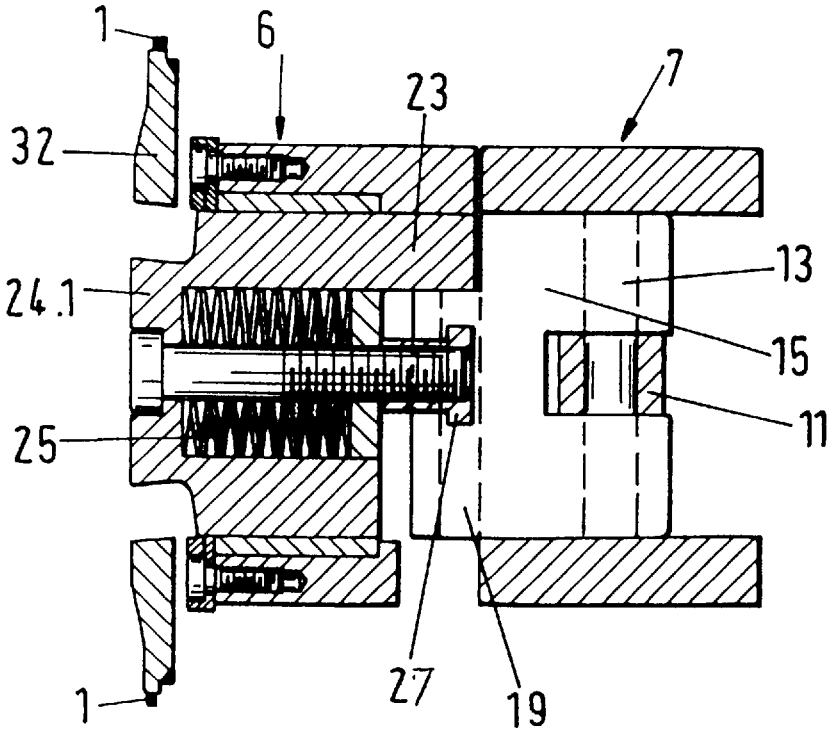

FIGS. 8*a* to 8*c* show the next phase of the disengagement process. The shifter 8 has moved the coupling device 7 further in the direction of arrow 36 to such an extent that the coupling member 15 can be moved by the piston and cylinder unit 9 and the lever 11 to the left, as shown in FIG. 8*b*, whereby the coupling piece 27 enters the sickle-shaped recess 18. As a consequence of the displacement of the coupling member 15 toward the locking bolt 24, the transverse bore 19 of the coupling member 15 is in alignment with the coupling piece 27 of the locking device 6. A movement of the shifter 8 in the direction of extension ("moving out") causes an interlocking engagement of the coupling piece 27 in the transverse bore 19, as shown in FIG. 8*c*. When the coupling device 7 is further moved by the shifter 8 in the direction of extension, the leading end face 37 of the coupling member 15 impacts against a confronting inside surface of the leg 23 of the locking bolt 24, so that the shifter 8 of the actuating device can apply a force onto the locking device 6 when the coupling member 15 impacts against the locking bolt 24, and the head portion 24.1 of the locking bolt 24 can be disengaged from the edge zone of the ring-shaped insert 32, as shown in FIG. 8*c*. In this position, the locking bolt 24 can be drawn.

Figure 9A:
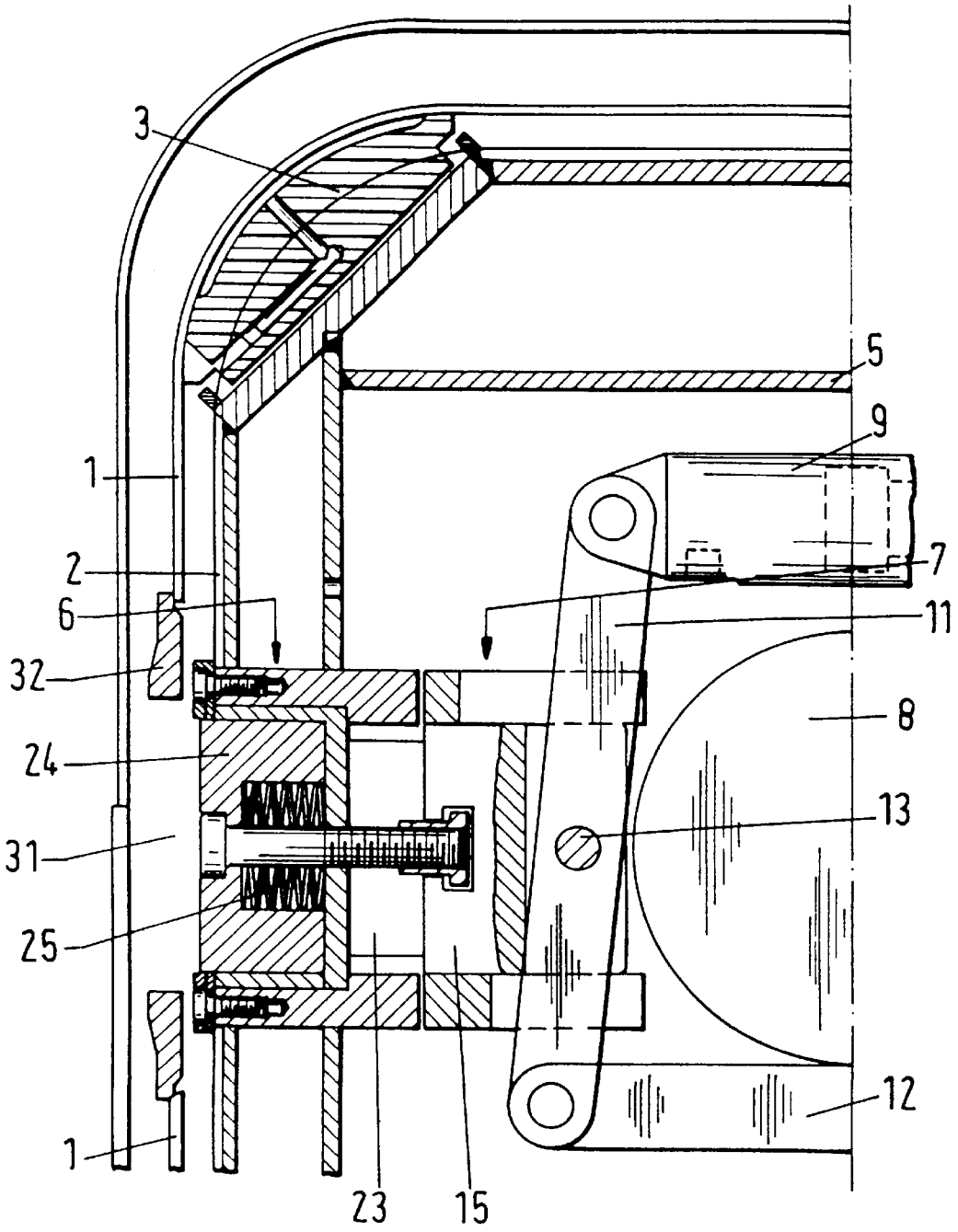
FIG. 9*a* is a cross sectional view of the luffing jib of FIG. 7*a* in a third phase of the coupling and release process.
Figure 9B:
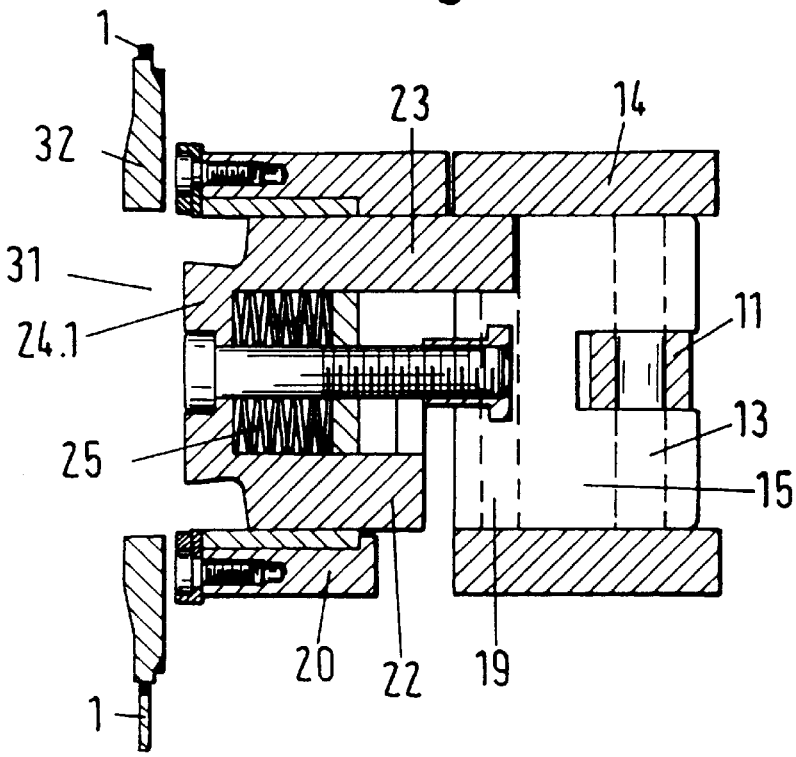
FIGS. 9*b,c* are cutaway views in longitudinal section of the luffing jib of FIG. 9*a*, illustrating in detail movement patterns during the third phase.
Figure 9C:
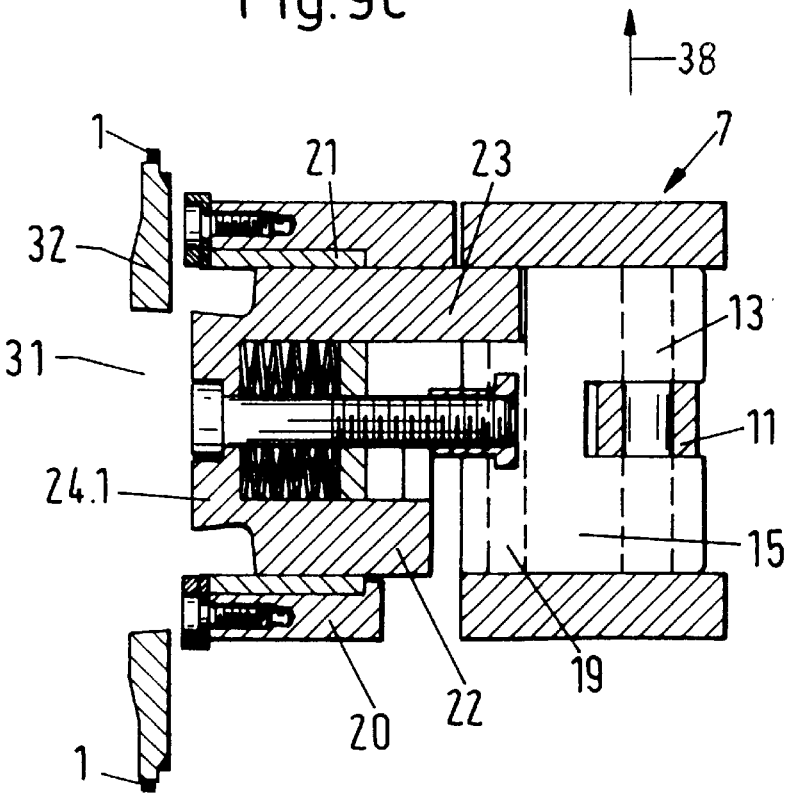

FIGS. 9*a* to 9*c* show the third or last phase of the disengagement process. After engagement of the coupling piece 27 of the locking bolt 24 in the bore 19 of the coupling member 15, the hydraulic piston and cylinder unit 9 is activated to move the coupling member 15 via the lever 11 to the right in opposition to the spring tension exerted by the spring 25. The interlocking engagement between the locking device 6 and the coupling device 7 results in a displacement of the locking bolt 24 away from the receptacle 31 of the jib member 1 and thereby in a release of the jib members 1, 2. The same process steps are carried out on the opposite right side, i.e. the locking bolt 24 on the right side is disengaged from the pertaining opening 32 of the jib member 1. During displacement of the locking bolt 24 to the right, the leg 23 moves into the recess 18 of the coupling member 15, and the shank 22 is also moved to the right beyond the sleeve 20, as shown in FIG. 9*b*. Once, the jib members 1, 2 are disengaged from one another, the jib member 2 is moved by the shifter 8 in axial direction in the direction of extension ("moving out") as indicated by arrow 38.

Disengagement of the coupling piece 27 and locking of the jib members 1, 2 to one another is carried in reverse sequence.

In conjunction with very small and lightweight luffing jibs, it is normally sufficient to provide only one locking device 6 which can be disposed in the telescoping one of the jib members 1, 2 centrally at the top or centrally at the bottom, whereby the associated receptacle 31 of the jib member enclosing the telescoping jib member is then suitably provided in the upper wall or bottom wall, respectively, as described e.g. in the afore-mentioned U.S. Pat. No. 5,628,416. In conjunction with bigger jibs, the provision of two locking devices 6 may be suitable as a consequence of torque applied on the actuating device, wherein the axes of both locking devices 6 and their interacting coupling devices 7 intersect the center axis of the actuating device at a right angle. Suitably, both locking devices 6 are arranged in opposing sidewall regions. However, an arrangement with both locking devices arranged in the top wall and bottom wall may be suitable as well.

While the invention has been illustrated and described as embodied in a crane with a luffing jib, it should not be limited to the details shown since various modifications and structural changes may be made without departing in any way from the spirit of the present invention.

What is claimed is:

1. A crane, comprising:

a luffing jib having individual telescoping jib members;

a locking device configured for linkage of jib members and movable between an engagement position in which the jib members are locked together and a release position in which a first one of the jib members can be moved in and out relative to a second one of the jib members, said locking device being supported in the first jib member and received in a receptacle of the second jib member;

a coupling device; and an actuating device defining an axis and including a shifter, movable in a direction of the axis, for shifting the locking device via the coupling device between the engagement and release positions;

said coupling device extending perpendicular to the axis and connected to the shifter, said coupling device having a coupling member movable in a radial direction to effect an interlocking engagement with the locking device which is movable in a same axis as the coupling member, said locking device forming together with the coupling member a coupling between the shifter and the first jib member, wherein in a transition phase between release and engagement positions, a projecting portion of the coupling member enters in form-fitting engagement with the locking device.

2. The crane of claim 1 wherein the actuating device includes a cable drive.

3. The crane of claim 1 wherein the actuating device includes a hydraulic piston and cylinder unit.

4. The crane of claim 3 wherein the piston and cylinder unit has a cylinder and a stationary piston rod extending out of the cylinder, said coupling element being disposed in an end region of the cylinder.

5. The crane of claim 3 wherein the piston and cylinder unit has a stationary cylinder, a piston rod having one end extending out of the cylinder for attachment of a crossbar, and a guide member mounted to the crossbar at a distance to the cylinder in parallel relation, said guide member having an end zone connected to the coupling element.

6. The crane of claim 1 wherein the locking device includes a spring-loaded locking bolt, which has one end proximal to the coupling member, and a coupling piece mounted to the one end of the locking bolt.

7. The crane of claim 6 wherein the coupling device includes a sleeve mounted to the shifter, said coupling member being guided in the sleeve for displacement and having a locking device confronting region which is formed with a first recess for receiving the coupling piece and a second recess for receiving a portion of the locking bolt, said actuating device including an actuator connected to the coupling member.

8. The crane of claim 6 wherein the locking device includes a sleeve fitted in an opening of the first jib member, said locking bolt being slidingly received in the sleeve and having a coupling-device-facing side which is provided with the coupling piece.

9. The crane of claim 6 wherein the coupling piece includes a shaft and an end piece mounted to the shaft and having a mushroom-like configuration, said coupling piece moving in and out of a T-shaped recess of the coupling member.

10. The crane of claim 8 wherein the locking device includes a slide bush fitted in the sleeve and having a bottom, and a crossbar positioned in the bottom of the slide bush and so connected to the sleeve as to define with the sleeve sickle-shaped openings for engagement of web-like projections of the locking bolt, with one of the web-like projections capable of moving in and out in a complementary recess of the coupling member.

11. The crane of claim 10 wherein the locking bolt has a central bore for receiving a spring having one end bearing against the locking bolt and another end bearing against the crossbar.

12. The crane of claim 11 wherein the locking bolt defines a center axis, said locking device further including a screw extending through the locking bolt and the crossbar and having one end configured for threaded engagement of the coupling piece.

13. The crane of claim 1 wherein the shifter has means disposed in an end zone of the shifter for actuating the coupling member.

14. The crane of claim 13 wherein said means include a hydraulic piston and cylinder unit which is positioned transversely to the axis of the actuating device.

15. The crane of claim 1 wherein the locking device is arranged in the first jib member centrally at an upper area or at a lower area, and received in the receptacle formed in an upper wall or lower wall of the second jib member.

16. The crane of claim 1, having two of said coupling device arranged at an end zone of the shifter and defined by axes intersecting the axis of the actuating device at a right angle, said two coupling devices configured for coupling with two confronting locking devices via respective coupling members and locking bolts.

17. The crane of claim 16 wherein both locking devices are arranged in opposite side walls of the first jib member destined for extension, with pertaining receptacles being formed in the second jib member.

18. A crane:

a first jib member;

a second jib member, said first jib member nested in the second jib member and destined to move in and out with respect to the second jib member;

a coupling and locking device for locking the first and second jib members in an engagement position and disengaging the first and second jib members in a release position to allow an extension of the second jib member, and for coupling the first and second jib members to one another during a transition phase between the engagement and release positions, said coupling and locking device including a locking element supported in the first jib member and having a portion destined for projection into a receptacle of the second jib member, and a coupling member configured for interlocking engagement with the locking element, said coupling member being movable in an axial direction relative to the locking element and in a radial direction for alignment with the locking element and implementation of the interlocking engagement.

19. The crane of claim 18, and further comprising an actuating device defining an axis and including a shifter, movable in a direction of the axis, for shifting the coupling device in the axial direction.

20. The crane of claim 19 wherein the coupling member extends perpendicular to the axis and is connected to the shifter.

21. The crane of claim 18 wherein the locking element includes a spring-loaded locking bolt which has one coupling-member-proximal end, said coupling and locking device including a coupling piece mounted to the coupling-member-proximal end of the locking bolt, said locking bolt and said coupling piece interacting with one another to realize the interlocking engagement.

22. The crane of claim 21 wherein the coupling and locking device includes a sleeve mounted to the shifter, said coupling member being guided in the sleeve for displacement and having in confronting relation to the locking bolt a first recess for receiving the coupling piece and a second recess for receiving a portion of the locking bolt.

23. The crane of claim 21 wherein the coupling piece includes a shaft and an end piece mounted to the shaft and having a mushroom-like configuration, said coupling piece moving in and out of a T-shaped recess of the coupling member.

24. The crane of claim 21 wherein the locking element has openings destined for engagement of web-like projections of the locking bolt, with one of the web-like projections capable of moving in and out in a complementary recess of the coupling member.

25. The crane of claim 21 wherein the locking bolt defines a center axis, said coupling and locking device further including a screw extending through the locking bolt having one end configured for threaded engagement of the coupling piece.

26. The crane of claim 19 wherein the actuating device includes a hydraulic piston and cylinder unit which is positioned transversely to the axis of the actuating device.

* * * * *